US005487441A

United States Patent [19]

Endo et al.

[11] Patent Number: 5,487,441

[45] Date of Patent: Jan. 30, 1996

[54] MOTORIZED BOARD WITH PRESSURE ACTUATED POWER SWITCH

[75] Inventors: Sadao Endo; Yoshito Tokinaga; Kazuo Sasaki, all of Tokyo, Japan

[73] Assignee: Unitec Corporation, Tokyo, Japan

[21] Appl. No.: 61,884

[22] Filed: May 14, 1993

[30] Foreign Application Priority Data

Feb. 13, 1993 [JP] Japan ..... 5-047493

[51] Int. Cl.[6] ..... A63C 3/00

[52] U.S. Cl. ..... 180/181; 180/65.1; 280/87.042

[58] Field of Search ..... 180/180, 181, 180/65.1; 280/87.041, 87.042

[56] References Cited

U.S. PATENT DOCUMENTS 4,073,356 2/1978 Schlicht ..... 180/181
4,984,648 1/1991 Strzok ..... 180/181
5,020,621 6/1991 Martin ..... 180/180
5,127,488 7/1992 Shanahan ..... 180/180

FOREIGN PATENT DOCUMENTS 4060230 2/1994 Japan ..... 180/181

*Primary Examiner*—Richard M. Camby
*Attorney, Agent, or Firm*—Jordan and Hamburg

[57] ABSTRACT

A powered playing instrument is provided in which a plurality of wheels and a driving wheel propelled by a geared motor are mounted to the bottom surface of a board on which a foot or both feet of the player are placed and in action, the geared motor for the driving wheel is switched on and off by a remote or radio control or by sensing a pressure exerted on to the board.

1 Claim, 23 Drawing Sheets

MOTORIZED BOARD WITH PRESSURE ACTUATED POWER SWITCH

BACKGROUND OF THE INVENTION

The present invention relates to a powered playing instrument provided in the form of a skateboard, surfboard, or roller-skates powered by an electric motor(s).

Conventional skateboards and roller-skates have four wheels mount ed to the bottom surface of a bottom plate or shoe bottom thereof.

Such conventional skateboards and roller-skates are to be driven for running on the wheels by means of the leg(s) of a player who will thus be exhausted easily when playing hard. This makes a long-distance run difficult, limits the manner of play, and allows selected groups of people to be players.

SUMMARY OF THE INVENTION

It is an object of the present invention, in view of overcoming the foregoing drawbacks, to provide an electrically powered playing instrument which is capable of self-propelling at a constant, stable speed thus to allow the player to carry out a long-distance run without much fatigue and to enjoy a more variety of plays than conventional like instrument without traditional skills.

The above and other objects and novel features of the present invention will be apparent from reading of the following description in conjunction with the accompanying drawings.

The drawings are illustrative and not limitative of the scope of the present invention.

DESCRIPTION OF THE PREFERRED EMBODIMENTS

Figure 1:
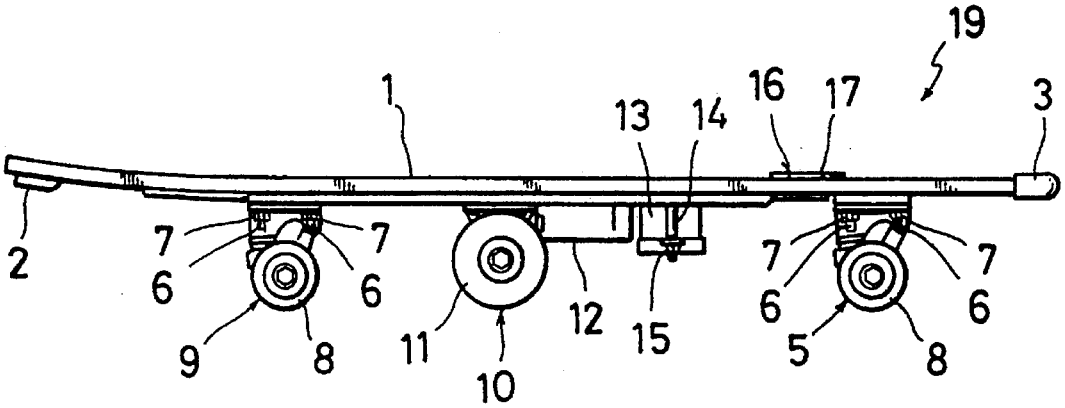
FIG. 1 is a side view showing a first embodiment of the present invention.
Figure 2:
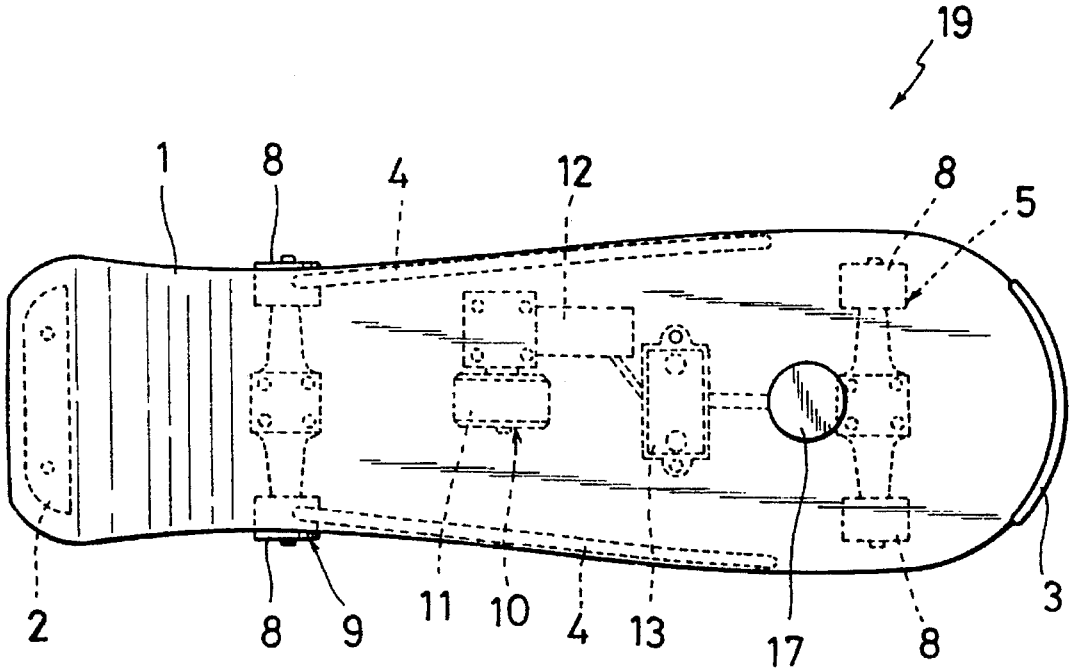
FIG. 2 is a plan view of the same.
Figure 3:
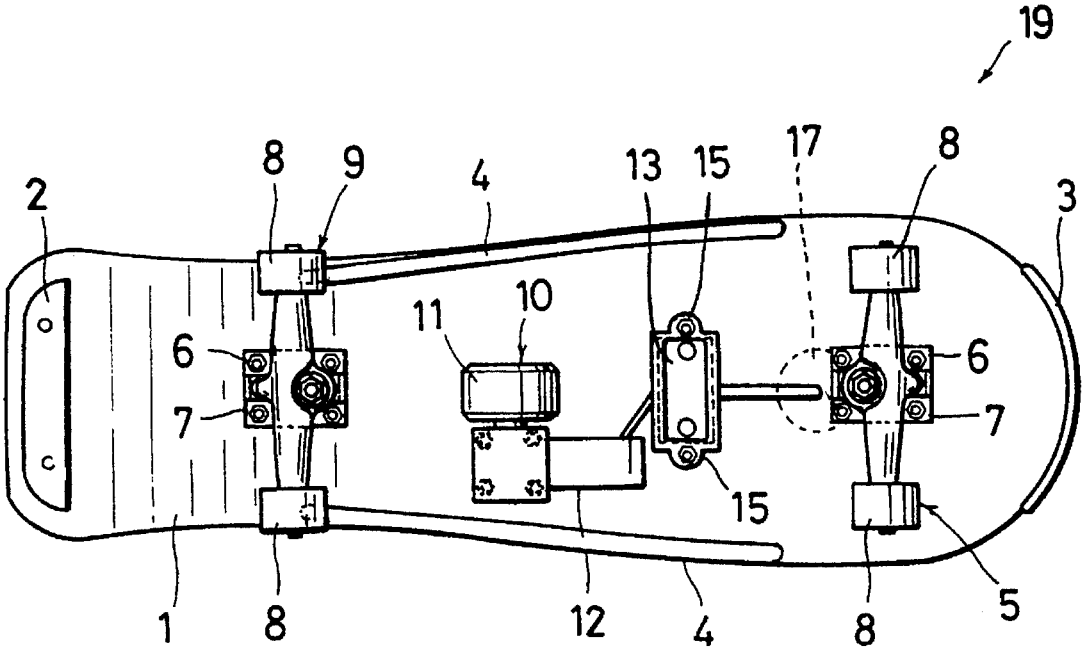
FIG. 3 is a bottom view of the same.
Figure 4:
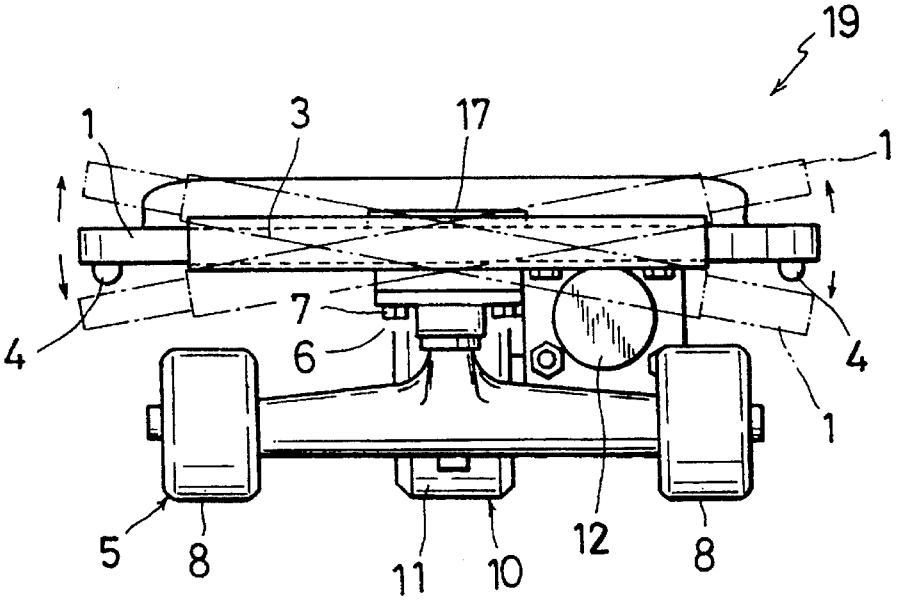
FIG. 4 is a front view of the same.
Figure 5:
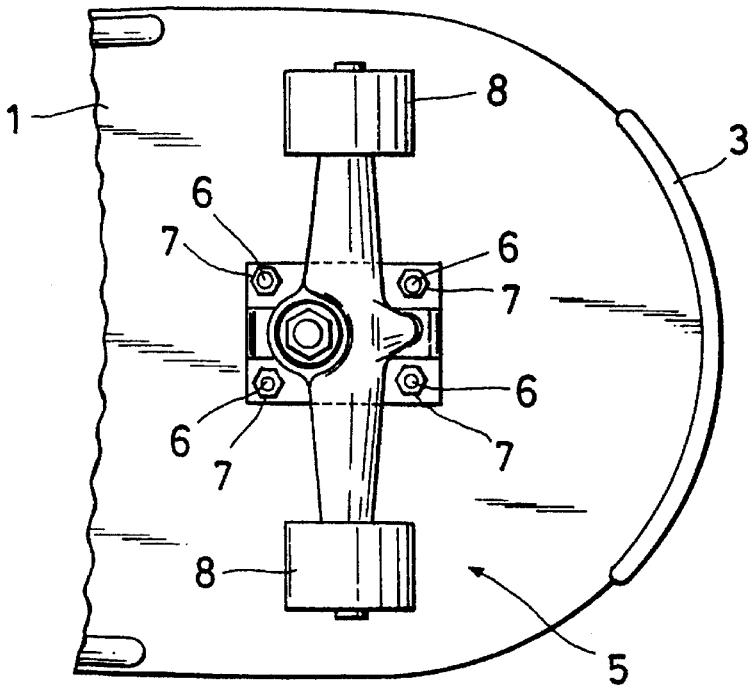
FIG. 5 is an explanatory view illustrating the mounting of front wheels of the same.
Figure 6:
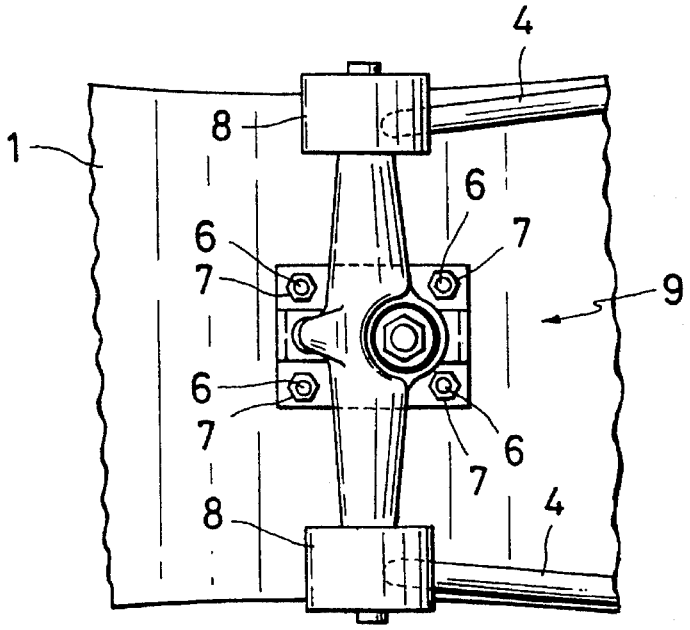
FIG. 6 is an explanatory view illustrating the mounting of rear wheels of the same.
Figure 7:
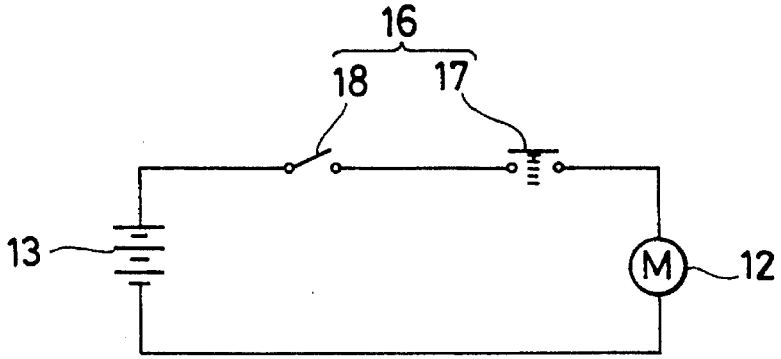
FIG. 7 is a schematic diagram of the circuit of the same.
Figure 8:
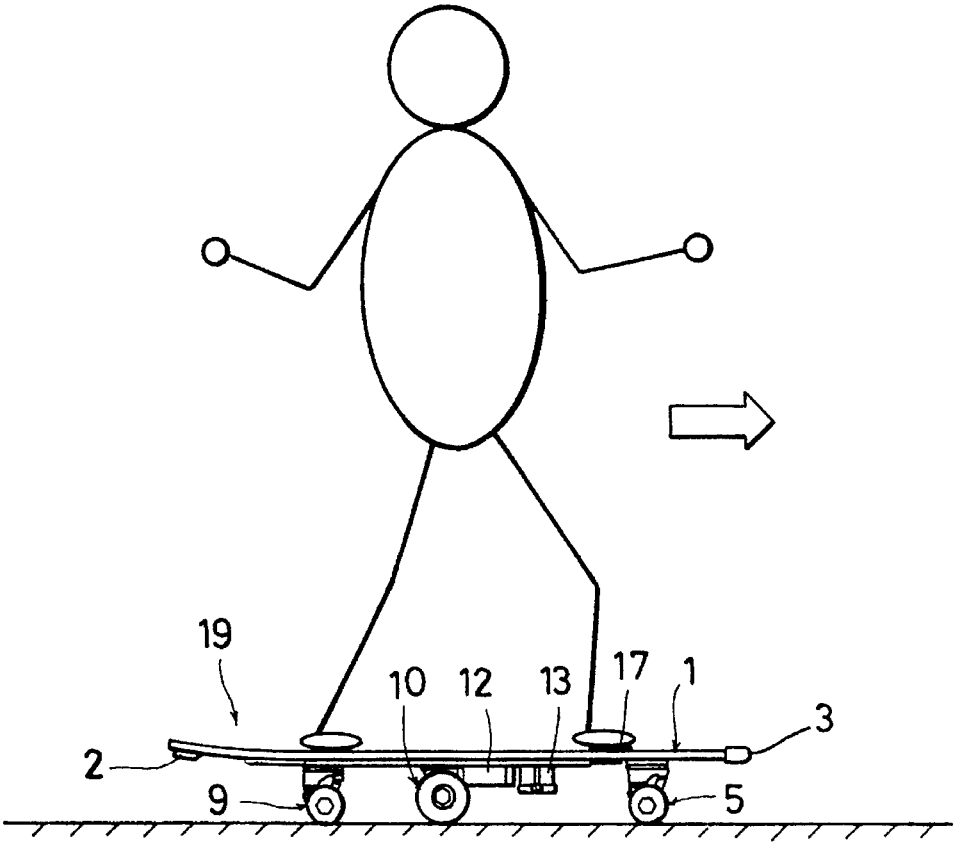
FIG. 8 is an explanatory view showing a use of the same.

Preferred embodiments of the present invention will be described referring to the accompanying drawings.

FIGS. 1 to 8 illustrate a first embodiment of the present invention in the form of a skateboard. The skateboard comprises a board 1 having a skateboard shape slightly turned upward at the rear end, a rear resilient pad 2 mounted to the rear bottom of the board 1 for protecting from shock, and resilient linings 3, 4, 4 mounted to the front and side ends of the same respectively.

The board 1 also has a front wheel unit 5 provided with a pair of wheels 8, 8 and mounted to a front location of the bottom surface thereof for movement in four, frontward, rearward, left, and right, directions. More specifically, the front wheel unit 5 like the front wheel unit of a traditional skateboard is fixedly attached by a resilient shim to the bottom surface of the board 1 using an appropriate number of bolts 6 and nuts 7.

Similarly, a rear wheel unit 9 incorporating a pair of wheels 8, 8 is mounted to a rear location of the bottom surface of the board 1 for movement in four, frontward, rearward, left, and right, directions. More specifically, the rear wheel unit 9 like the rear wheel unit of a traditional skateboard also is fixedly attached by a resilient shim to the bottom surface of the board 1 using an appropriate number of bolts 6 and nuts 7.

In particular, a drive unit 10 powered by a geared motor 12 is mounted to a lengthwise center portion of the bottom surface of the board 1 between the front 5 and rear wheel units 9 so that its wheel 11 can drive the board 1.

The geared motor 12 for propelling the drive unit 10 is energized with a current from a battery 13 which is detachably mounted with two sets of bolts 14,14 and nuts 15, 15 to the bottom surface of the board 1.

Also, the geared motor 12 is turned on and off by a switch unit 16. The switch unit 16 comprises a pressure switch 17 and an isolator switch 18 coupled across a connection line between the geared motor 12 and the battery 13. The pressure switch 17 turns on when the board 1 is loaded from upper while remaining turned off in a no-load condition.

In action, when the isolator switch 18 has been switched on and a player rides on the board 1 of the skateboard or powered playing instrument 19, the pressure switch 17 turns on to energize the geared motor 12. The geared motor 12 then rotates the wheel 11 of the drive unit 10 driving the powered playing instrument 19. The powered playing instrument 19 can be controlled by shift of the center of a load or gravity center on the board 1 in the same manner as of a traditional skateboard control.

The switch unit 16 may be activated for switching on and off the geared motor 12 by a remote or radio control means.

Other embodiments of the present invention will now be described referring to FIGS. 9 to 37. Like components are denoted by like numerals as of the first embodiment for simplicity of the description throughout the drawings and will be explained in no more details.

Figure 9:
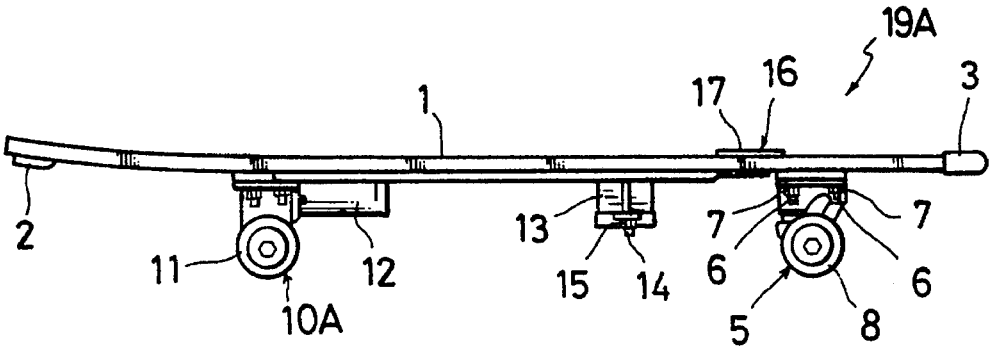
FIGS. 9 to 11 are explanatory views showing a second embodiment of the present invention.
Figure 10:
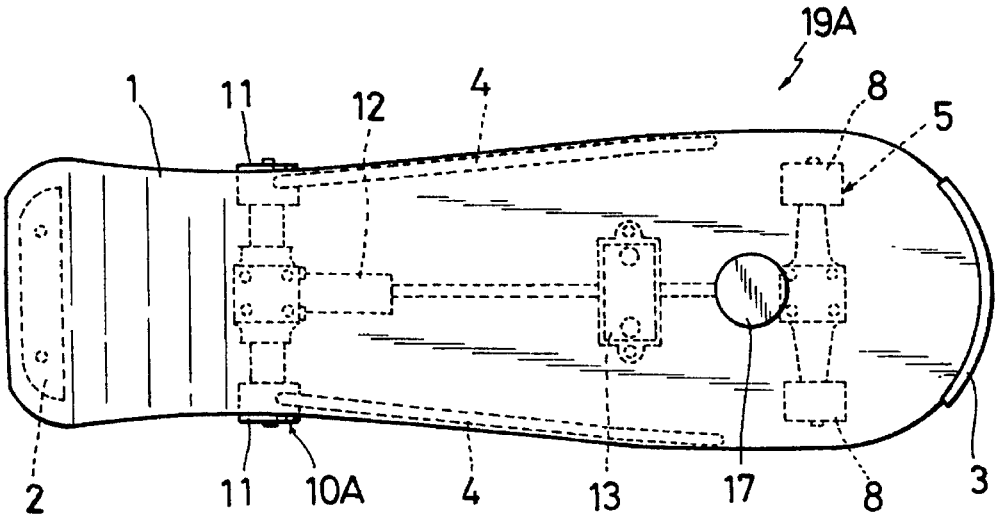
Figure 11:
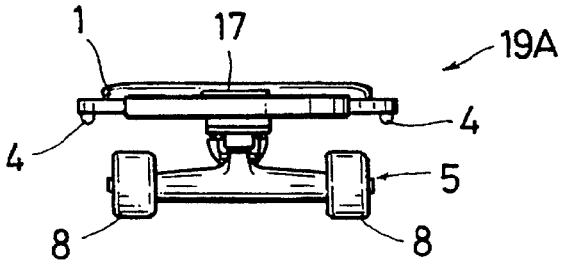

As shown in FIGS. 9 to 11, a second embodiment of the present invention is distinguished from the first embodiment by the fact that the rear wheel unit 9 is associated with a drive unit 10A which has two wheels 11,11 driven by the geared motor 12. Accordingly, a powered playing instrument 19A provided with the rear wheel drive unit 10A and arranged as a four-wheel skateboard will ensure equal effects to those of the first embodiment.

Figure 12:
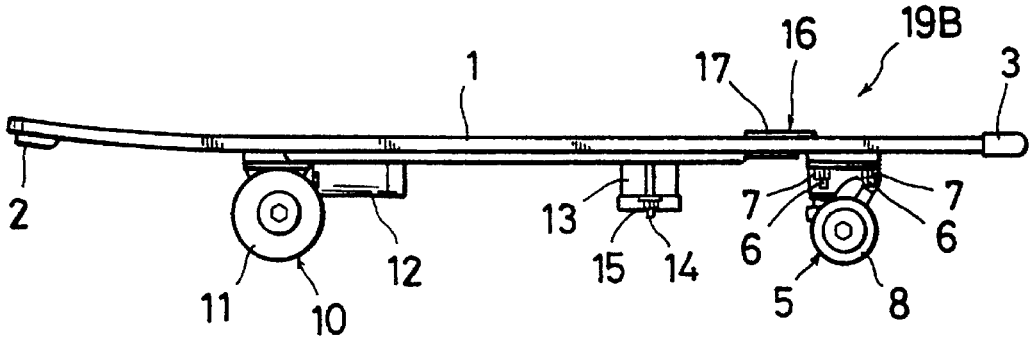
FIGS. 12 13 and 14 are explanatory views showing a third embodiment of the present invention.
Figure 13:
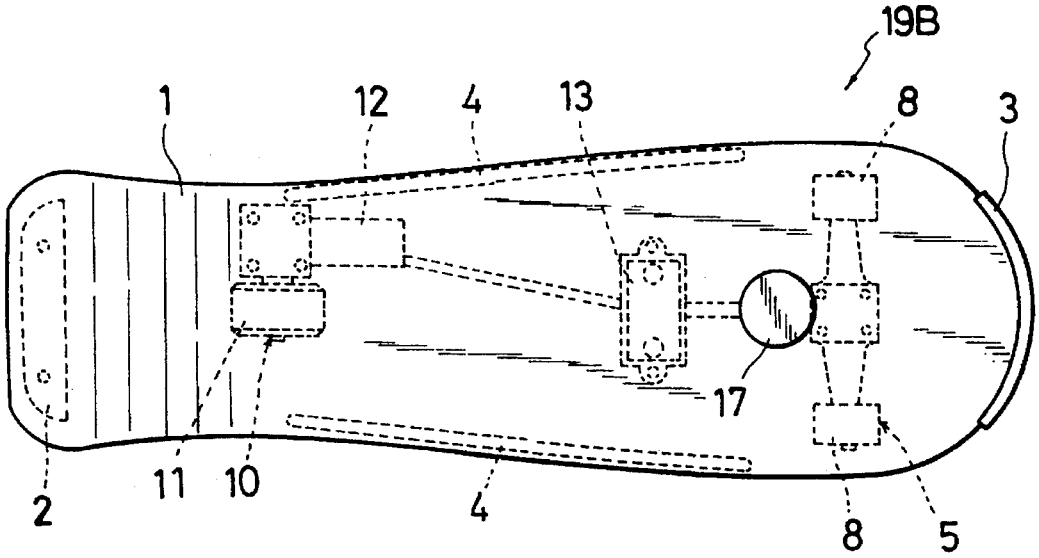
Figure 14:
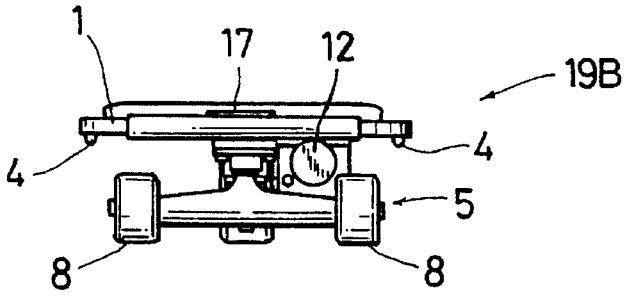

As illustrated in FIGS. 12 to 14, a third embodiment of the present invention is distinguished from the first embodiment by the fact that the drive unit 10 powered by the geared motor 12 is mounted to a rear portion of the bottom surface of the board 1 so that its driving wheel 11 can run at center while the rear wheel unit 9 is removed off. Accordingly, a powered playing instrument 19B arranged as a three-wheel skateboard will ensure equal effects to those of the first embodiment.

Figure 15:
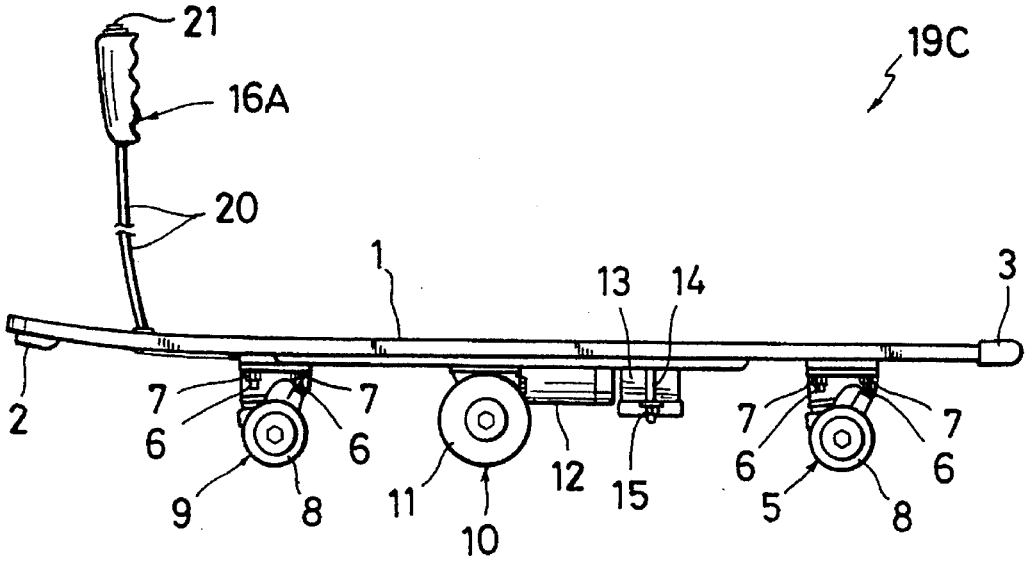
FIGS. 15 16 and 17 are explanatory views showing a fourth embodiment of the present invention.
Figure 16:
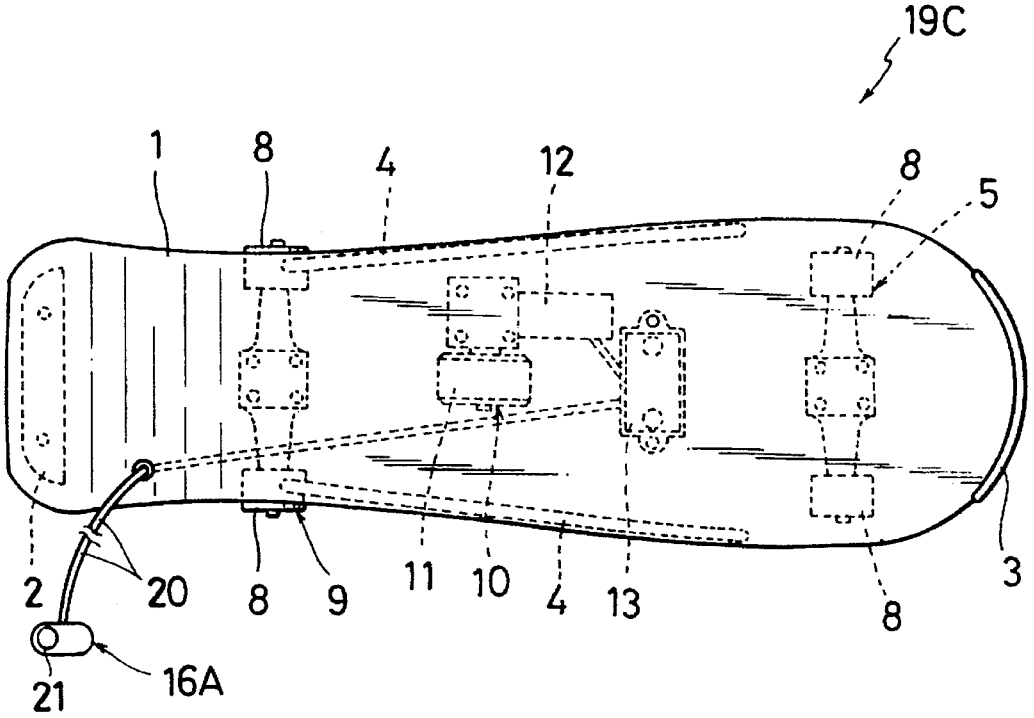
Figure 17:
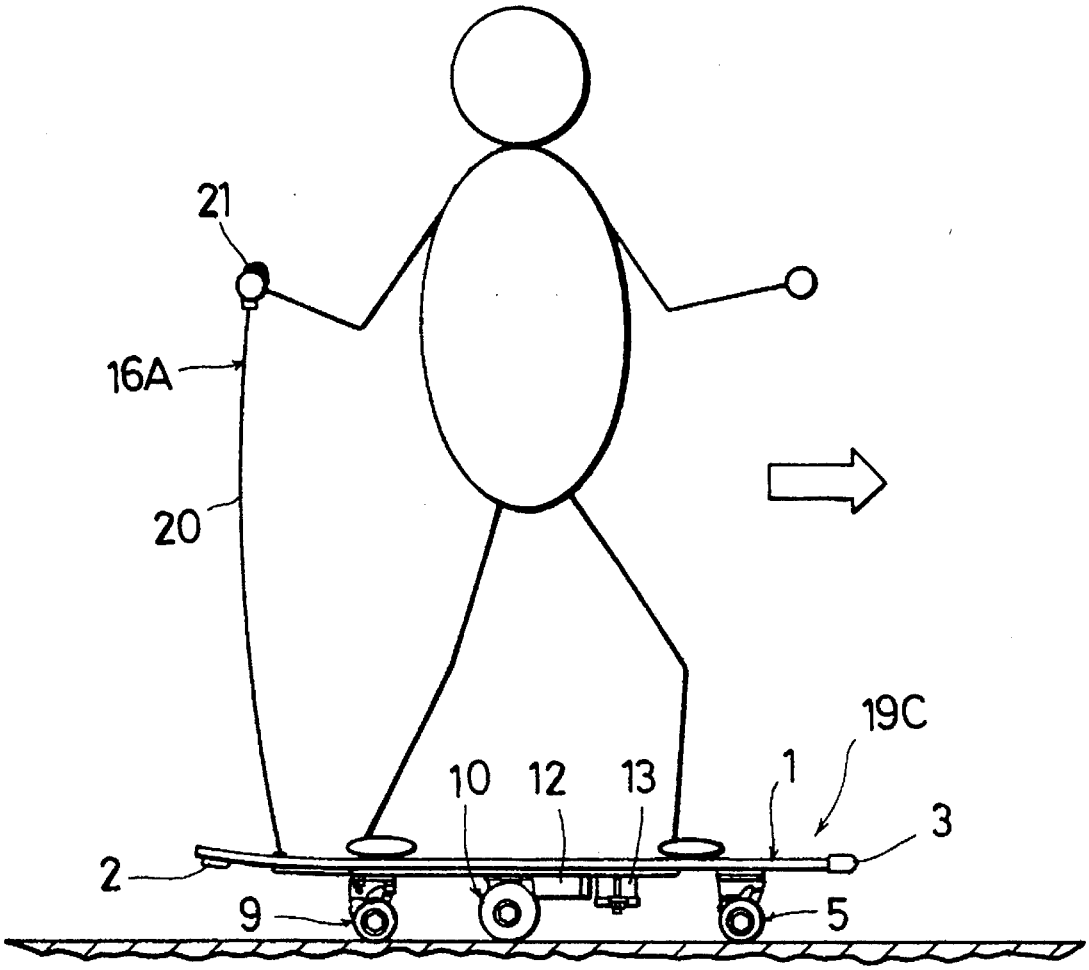

As shown in FIGS. 15 to 17, a fourth embodiment of the present invention is distinguished from the first embodiment by the fact that the switch unit 16 is replaced with a switch unit 16A which is mounted on a flexible arm 20 projecting upward from a rear side portion of the board 1 and carries at upper end a specific pressure switch 21 for maintaining the turn-on state by depressing it. Accordingly, a powered playing instrument 19C arranged as a five-wheel skateboard will ensure equal effects to those of the first embodiment.

The pressure switch 21 may be replaced with sensor switch capable of turning on when being gripped by a hand.

Figure 18:
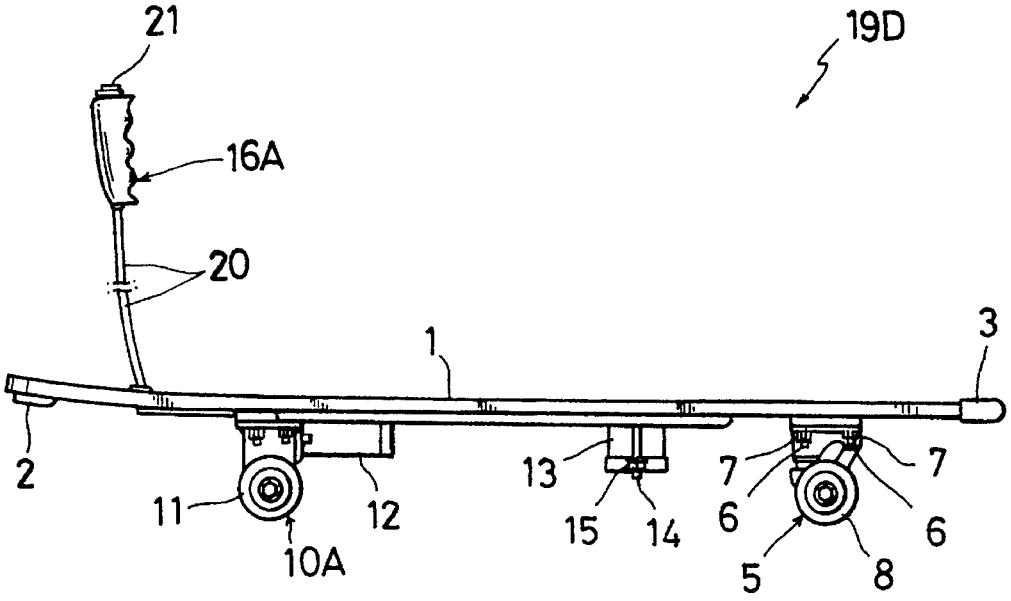
FIGS. 18 and 19 are explanatory views showing a fifth embodiment of the present invention.
Figure 19:
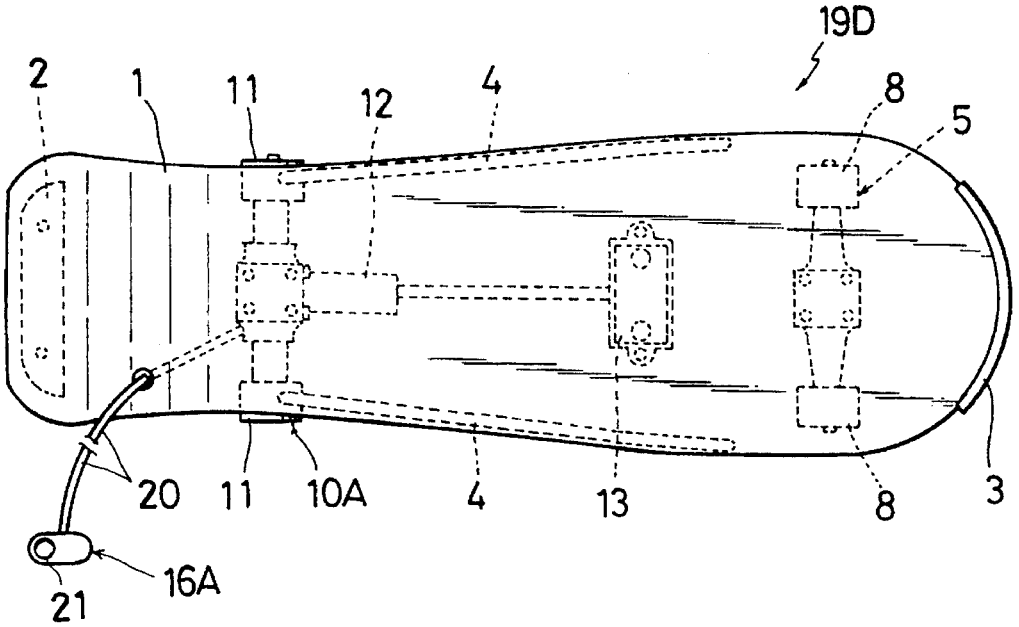

Referring to FIGS. 18 and 19, a fifth embodiment of the present invention is distinguished from the second embodiment by the fact that the switch unit 16 is replaced with a switch unit 16A which is mounted on a flexible arm 20 projecting upward from a rear side portion of the board 1 and carries at upper end a specific pressure switch 21 for maintaining the turn-on state by depressing it. Accordingly, a powered playing instrument 19D arranged as a four-wheel skateboard will ensure equal effects to those of the second embodiment.

Figure 20:
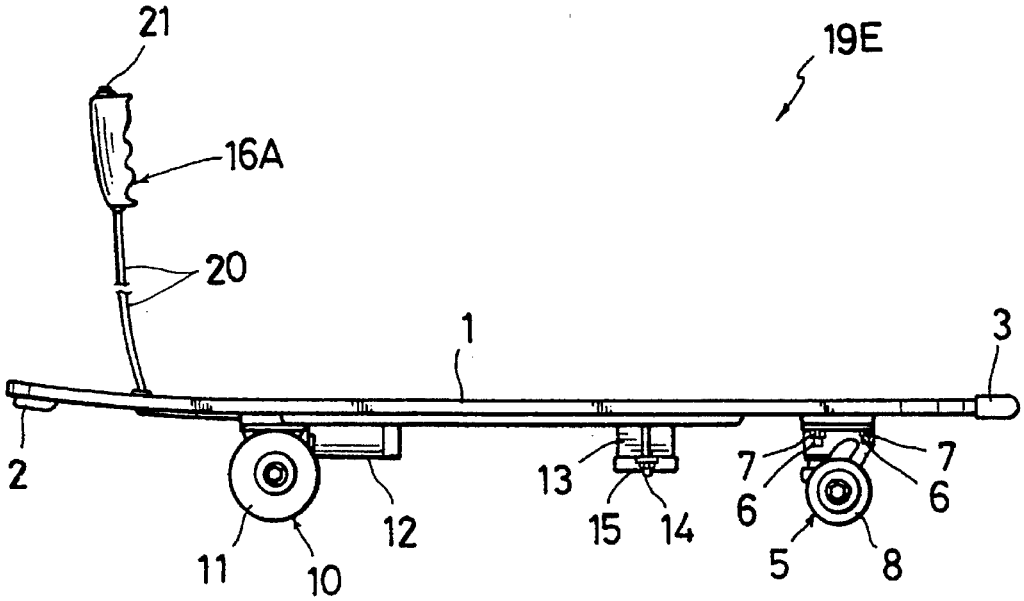
FIGS. 20 and 21 are explanatory views showing a sixth embodiment of the present invention.
Figure 21:
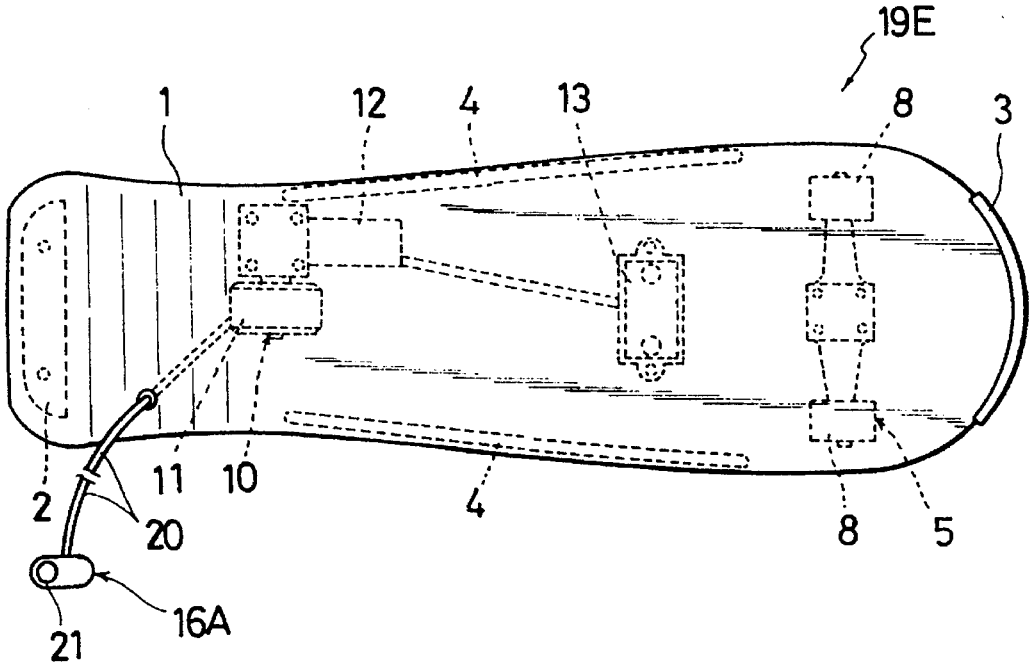
Figure 22:
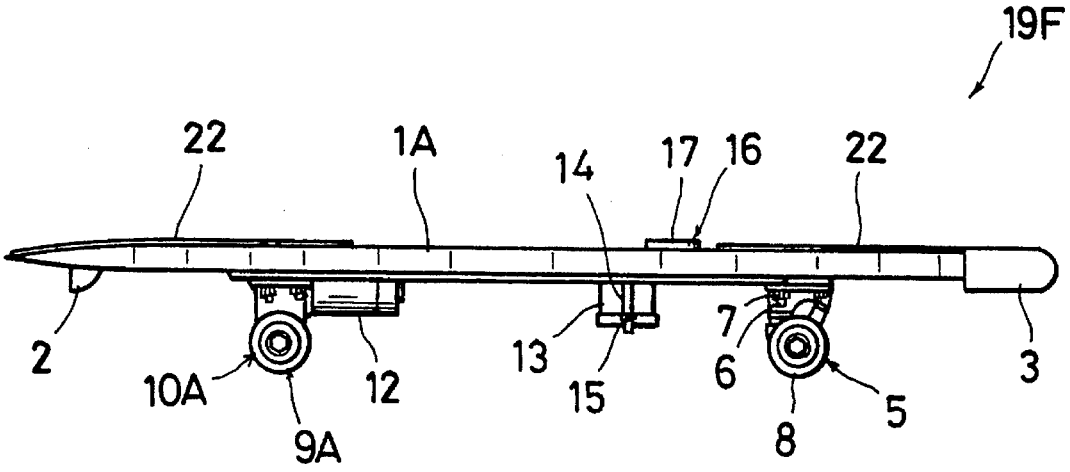
FIGS. 22, 23, 24 and 25 are explanatory views showing a seventh embodiment of the present invention.
Figure 23:
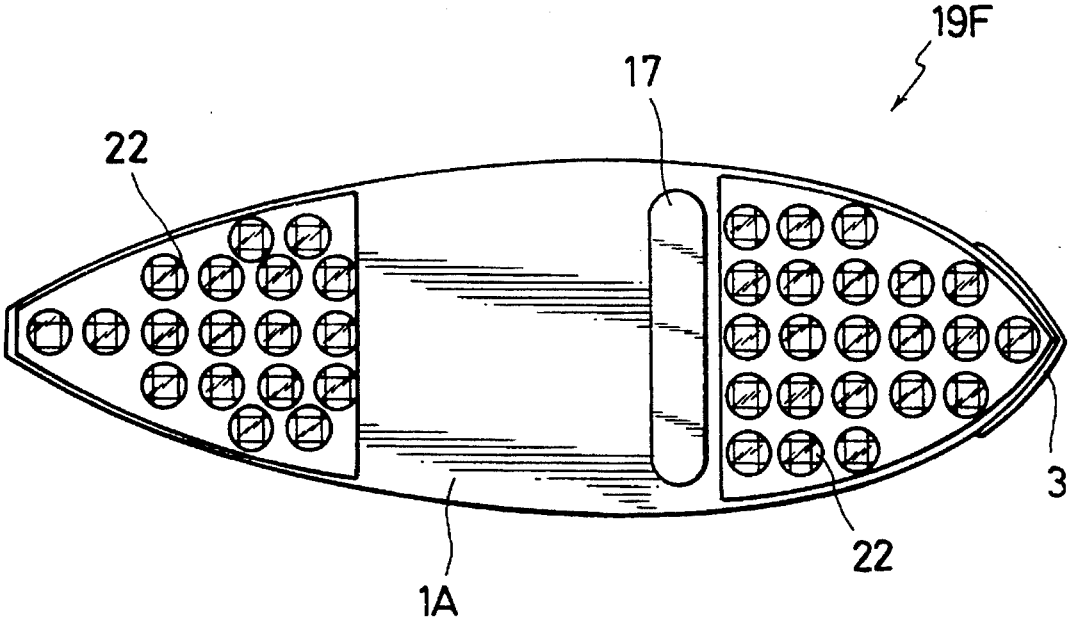
Figure 24:
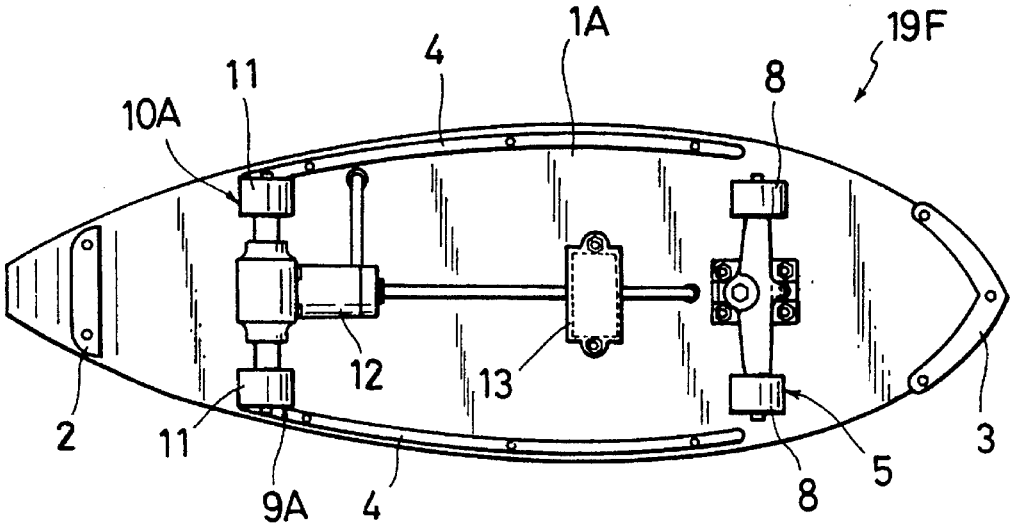
Figure 25:
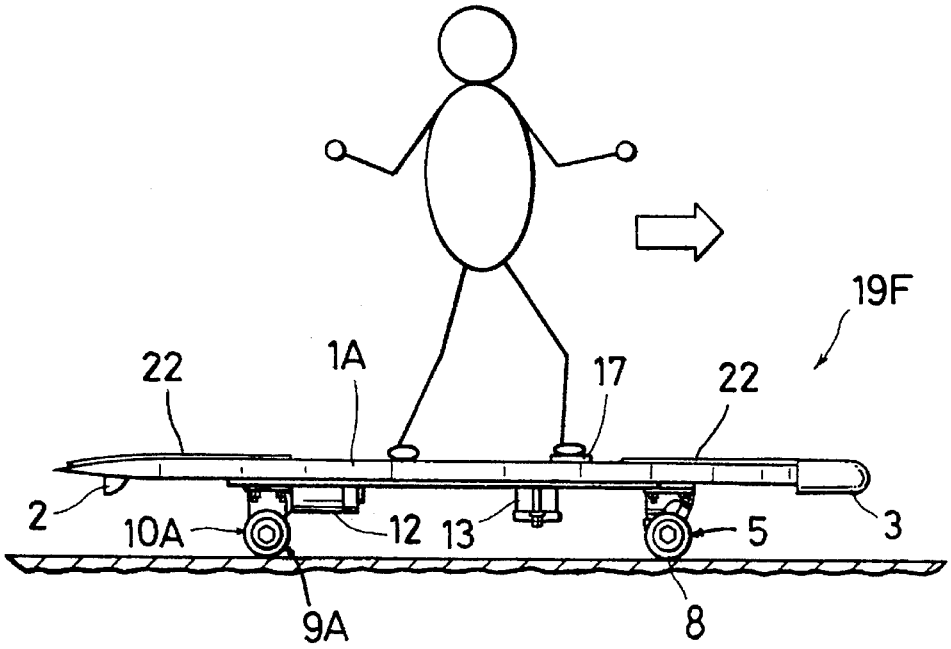

As shown in FIGS. 20 and 21, a sixth embodiment of the present invention is distinguished from the third embodiment by the fact that the switch unit 16 is replaced with a switch unit 16A which is mounted on a flexible arm 20 projecting upward from a rear side portion of the board 1 and carries at upper end a specific pressure switch 21 for maintaining the turn-on state by depressing it. Accordingly, a powered playing instrument 19E arranged as a three-wheel skateboard will ensure equal effects to those of the third embodiment.

As illustrated in FIGS. 22 to 25, a seventh embodiment of the present invention is distinguished from the second embodiment by the fact that the board 1 is replaced with a surfboard-shaped board 1A which carries a plurality of solar cells 22 on front and rear surface areas thereof while the drive unit 10A constitutes a rear wheel unit 9A arranged opposite to the front wheel unit 5. Accordingly, a powered playing instrument 19F arranged as a surfboard-shaped skateboard will ensure equal effects to those of the second embodiment.

Figure 26:
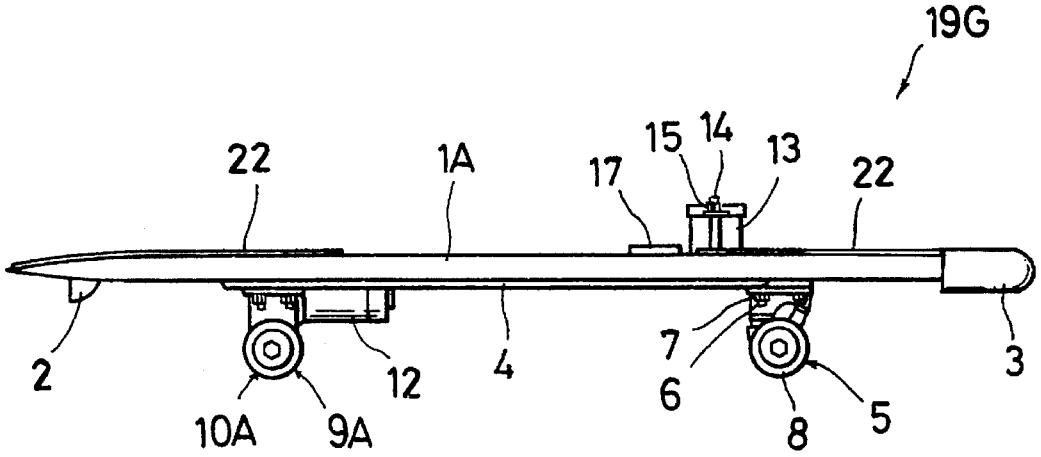
FIGS. 26 and 27 are explanatory views showing an eighth embodiment of the present invention.
Figure 27:
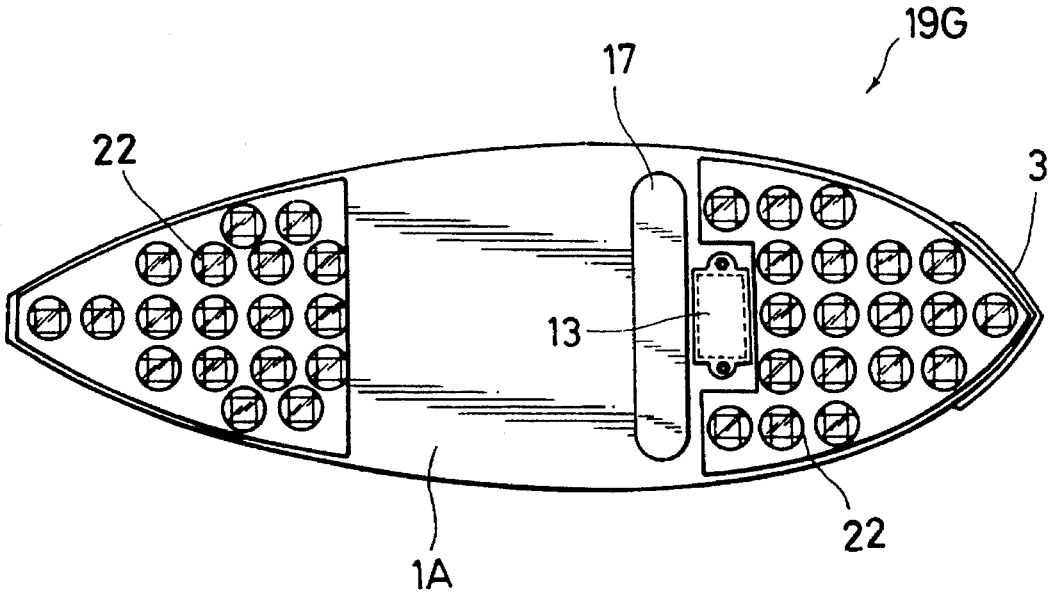

Referring to FIGS. 26 and 27, an eighth embodiment of the present invention is distinguished from the seventh embodiment by the fact that the battery 13 is placed on the surfboard-shaped board 1A. Accordingly, a powered playing instrument 19G arranged as a surfboard-shaped skateboard will ensure equal effects to those of the seventh embodiment.

Figure 28:
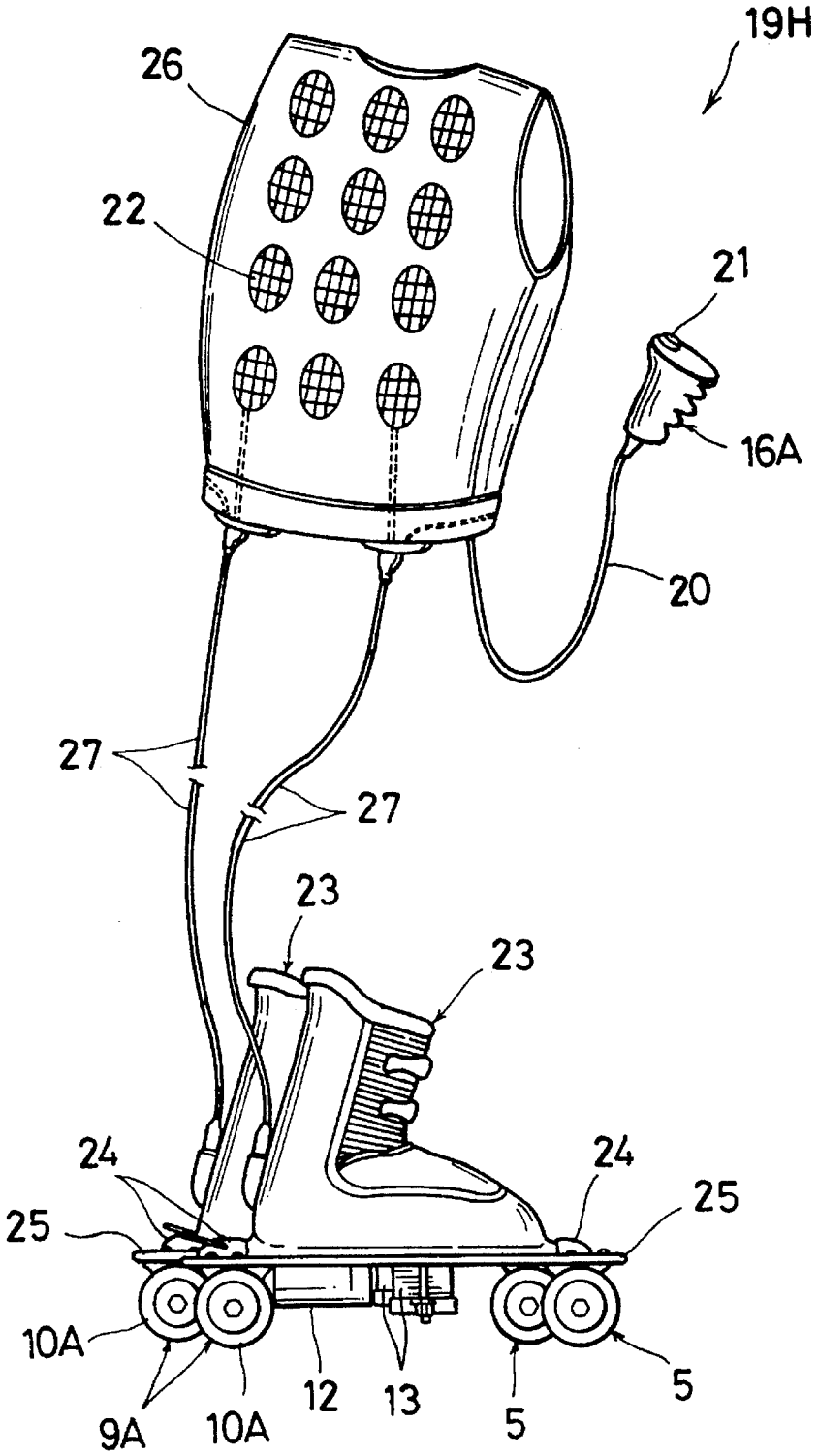
FIGS. 28, 29 and 30 are explanatory views showing a ninth embodiment of the present invention.
Figure 29:
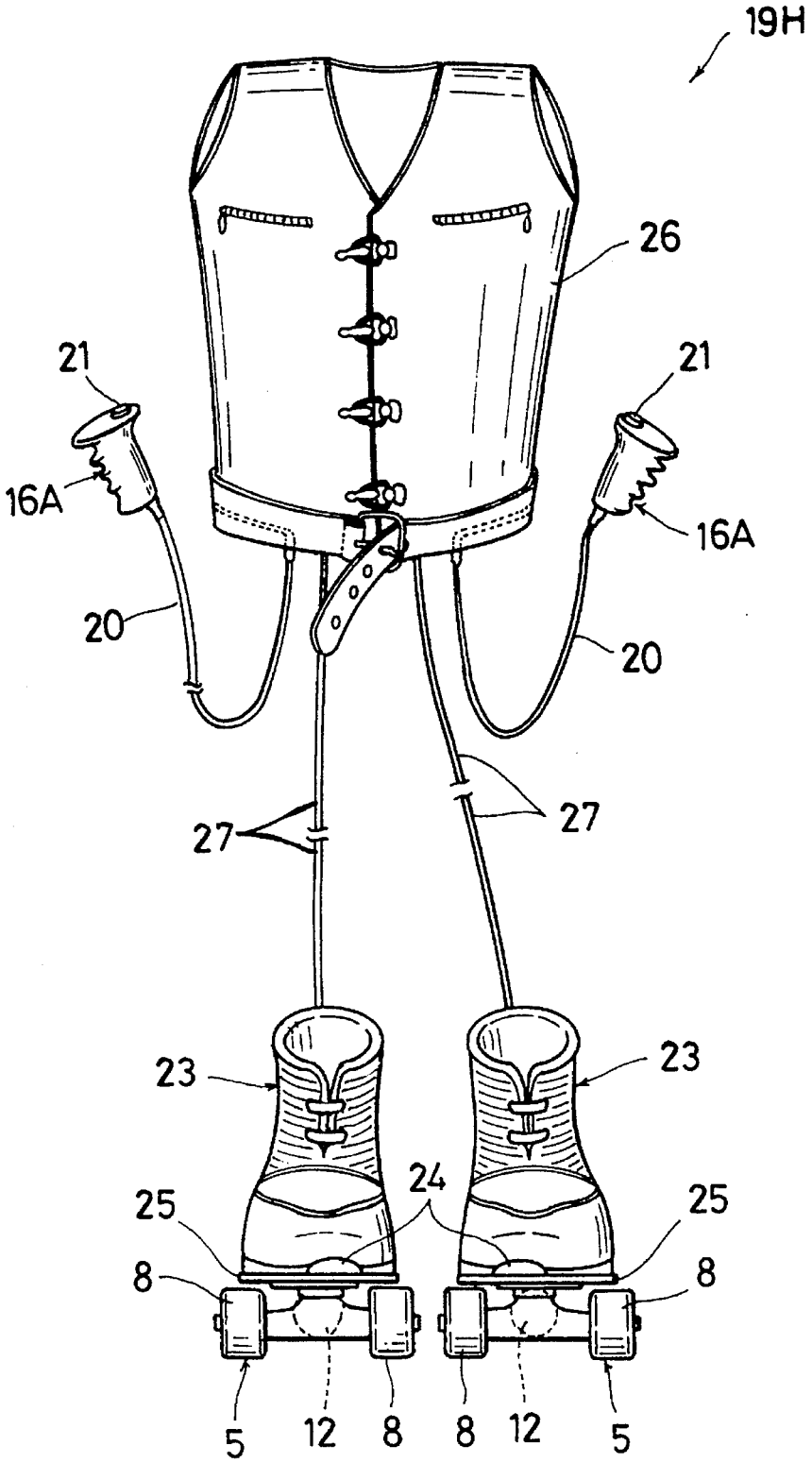
Figure 30:
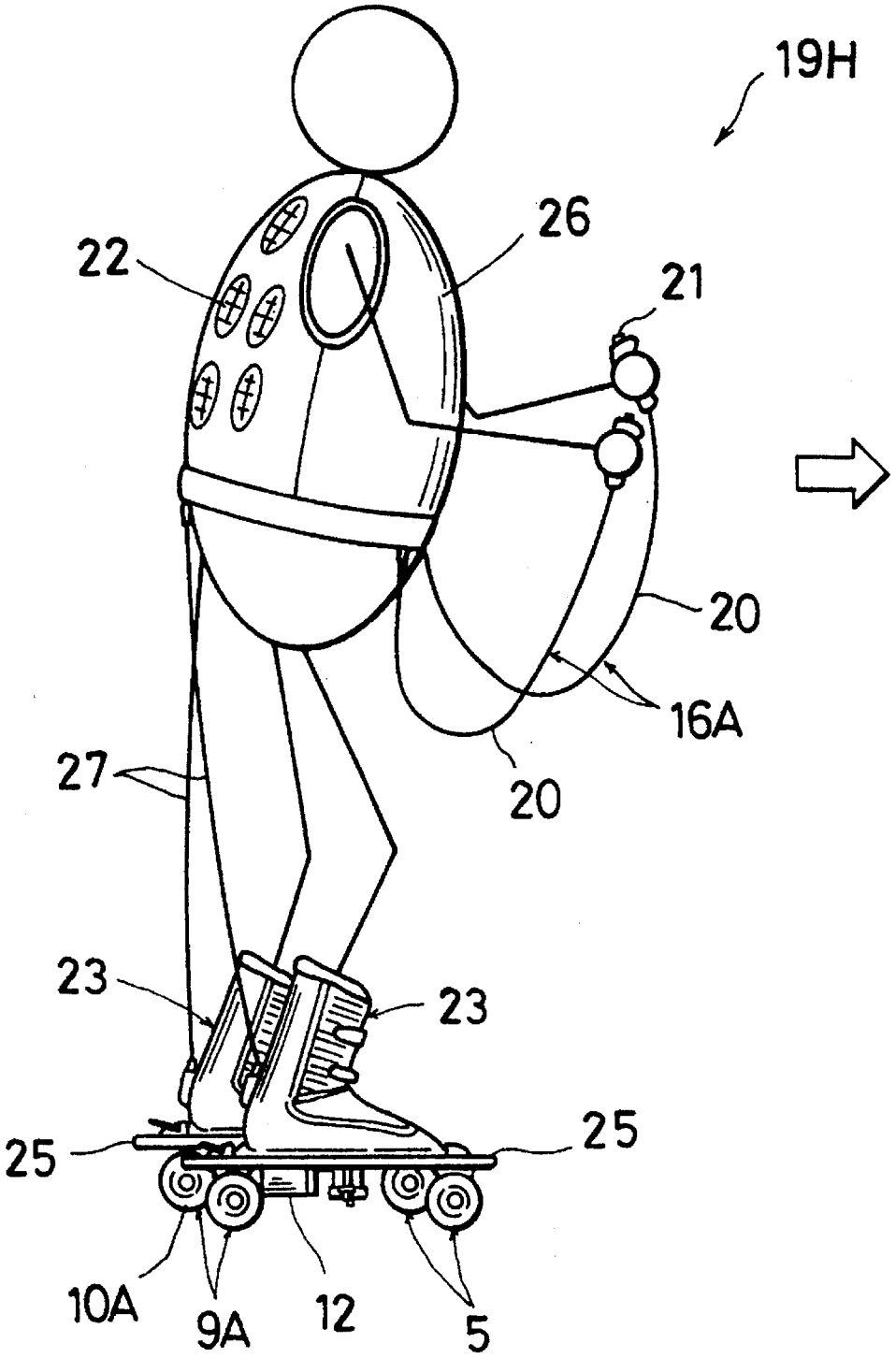

As shown in FIGS. 28 to 30, a ninth embodiment of the present invention is distinguished from the fifth embodiment by the fact that the front wheel unit 5 and the rear wheel unit 9A associated with the drive unit 10A are fixedly mounted to the bottom surface of each of two boards 25, 25 which are detachably mounted by fittings 24, 24 to the bottoms of two rollerskate shoes 23, 23 respectively and the fact that a plurality of solar cells 22 are arranged on a vest-like garment 26 that the player is wearing and also, the solar cells 22 are connected via a pair of cords 27, 27 to the two geared motors 12, 12 of their respective drive units 10A, 10A. Accordingly, a powered playing instrument 19H arranged as a pair of rollerskates will provide equal effects.

Figure 31:
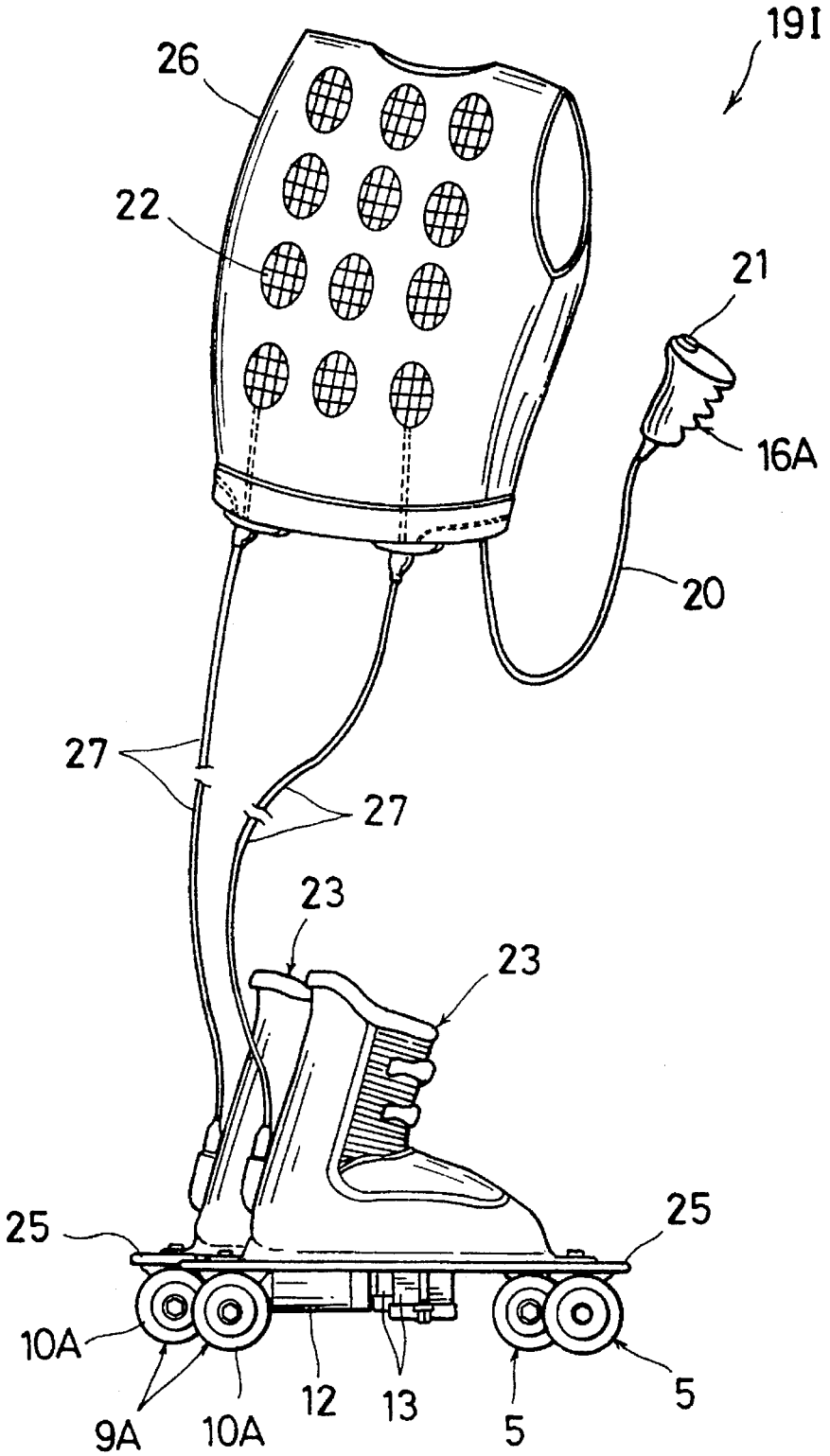
FIGS. 31 and 32 are explanatory views showing a tenth embodiment of the present invention.
Figure 32:
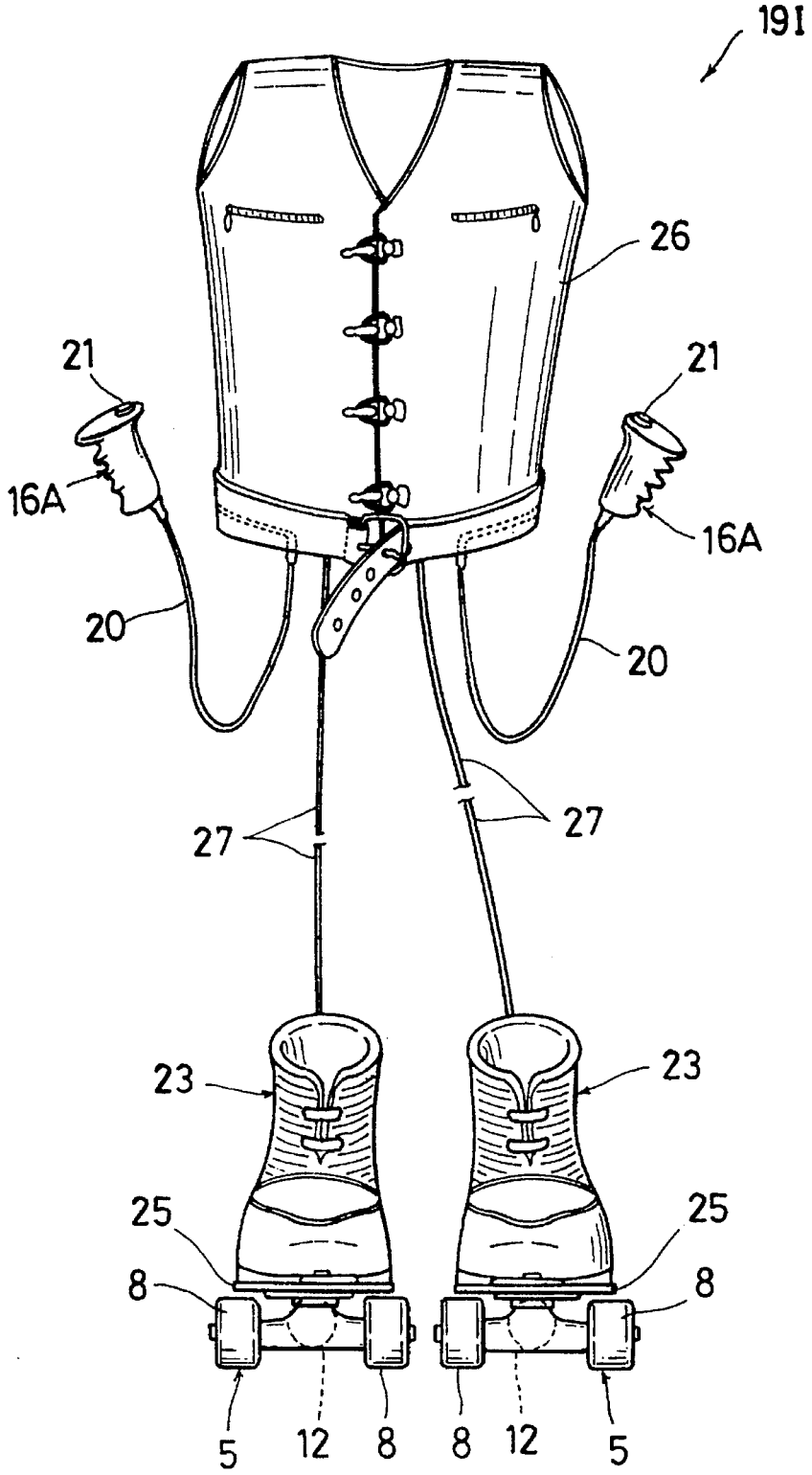

Referring to FIGS. 31 and 32, a tenth embodiment of the present invention is distinguished from the ninth embodiment by the fact that the two boards 25, 25 are fixedly mounted to the bottoms of their respective rollerskate shoes 23, 23. Accordingly, a powered playing instrument 19I arranged as a pair of rollerskates will ensure equal effects to those of the ninth embodiment.

Figure 33:
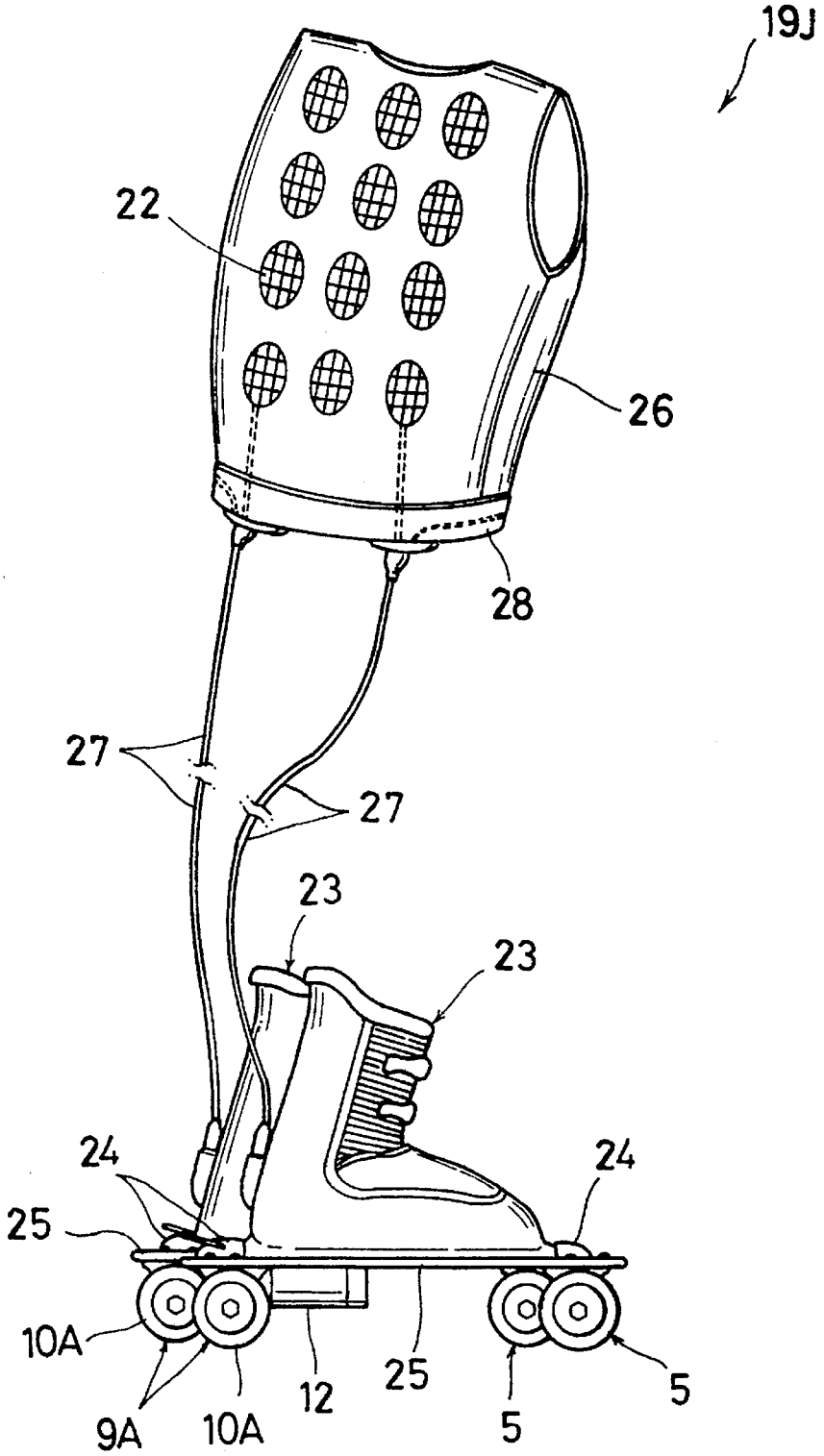
FIGS. 33, 34 and 35 are explanatory views showing an eleventh embodiment of the present invention.
Figure 34:
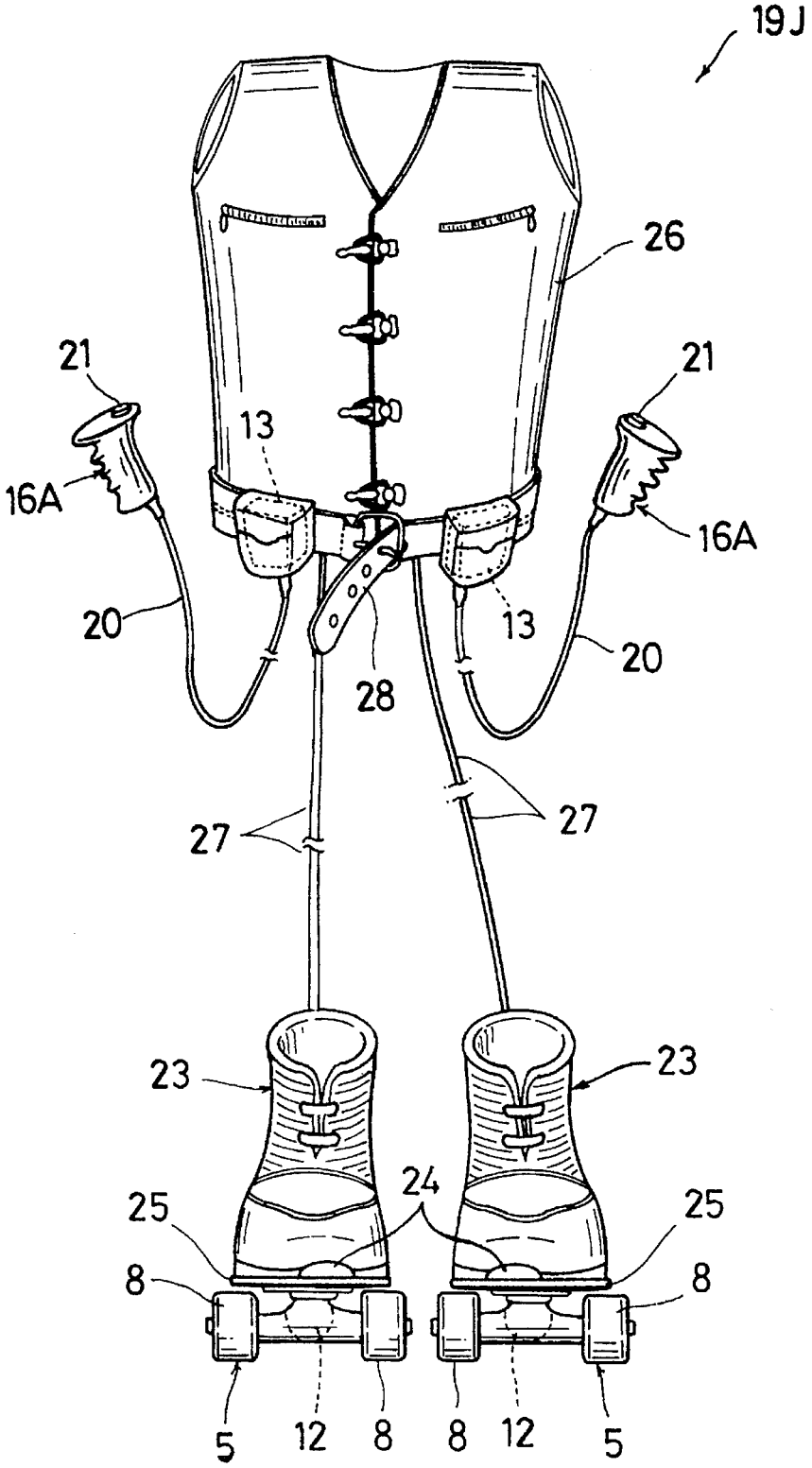
Figure 35:
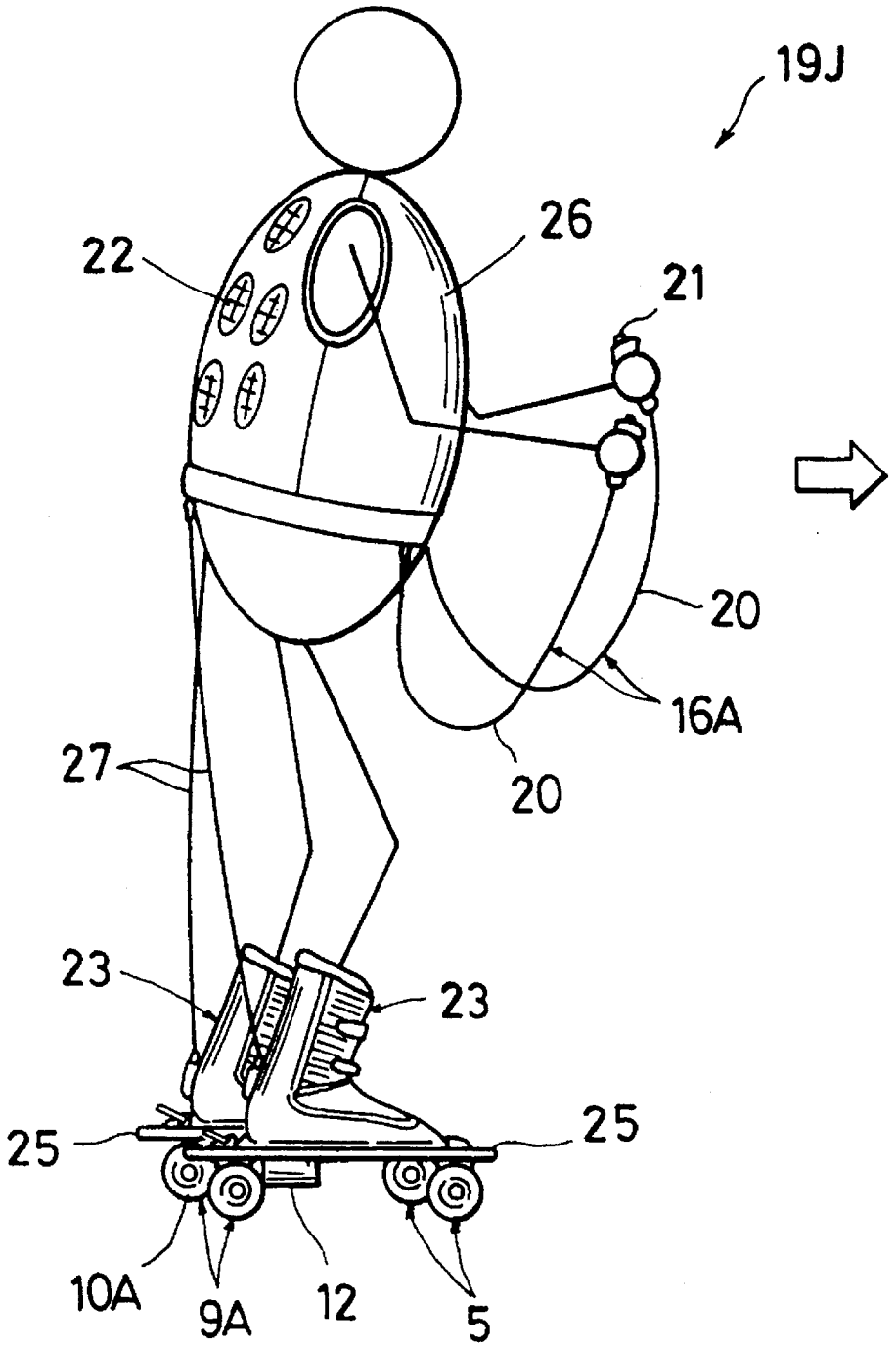

As shown in FIGS. 33 to 35, an eleventh embodiment of the present invention is distinguished from the ninth embodiment by the fact that two of the batteries 13, 13 are mounted to a belt 28 that the player is wearing. Accordingly, a powered playing instrument 19J arranged as a pair of rollerskates will provide equal effects.

Figure 36:
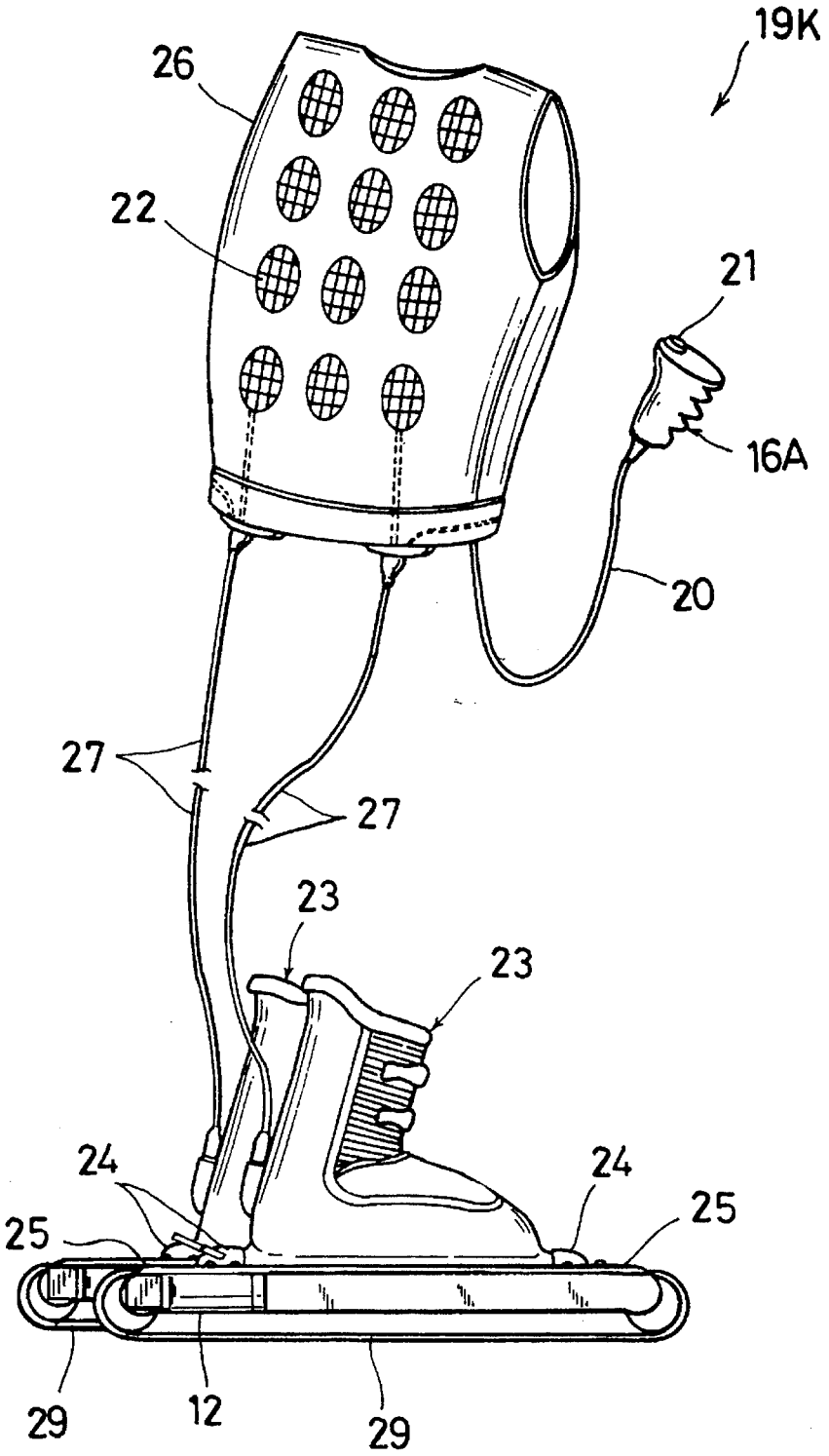
FIGS. 36 and 37 are explanatory views showing a twelfth embodiment of the present invention.
Figure 37:
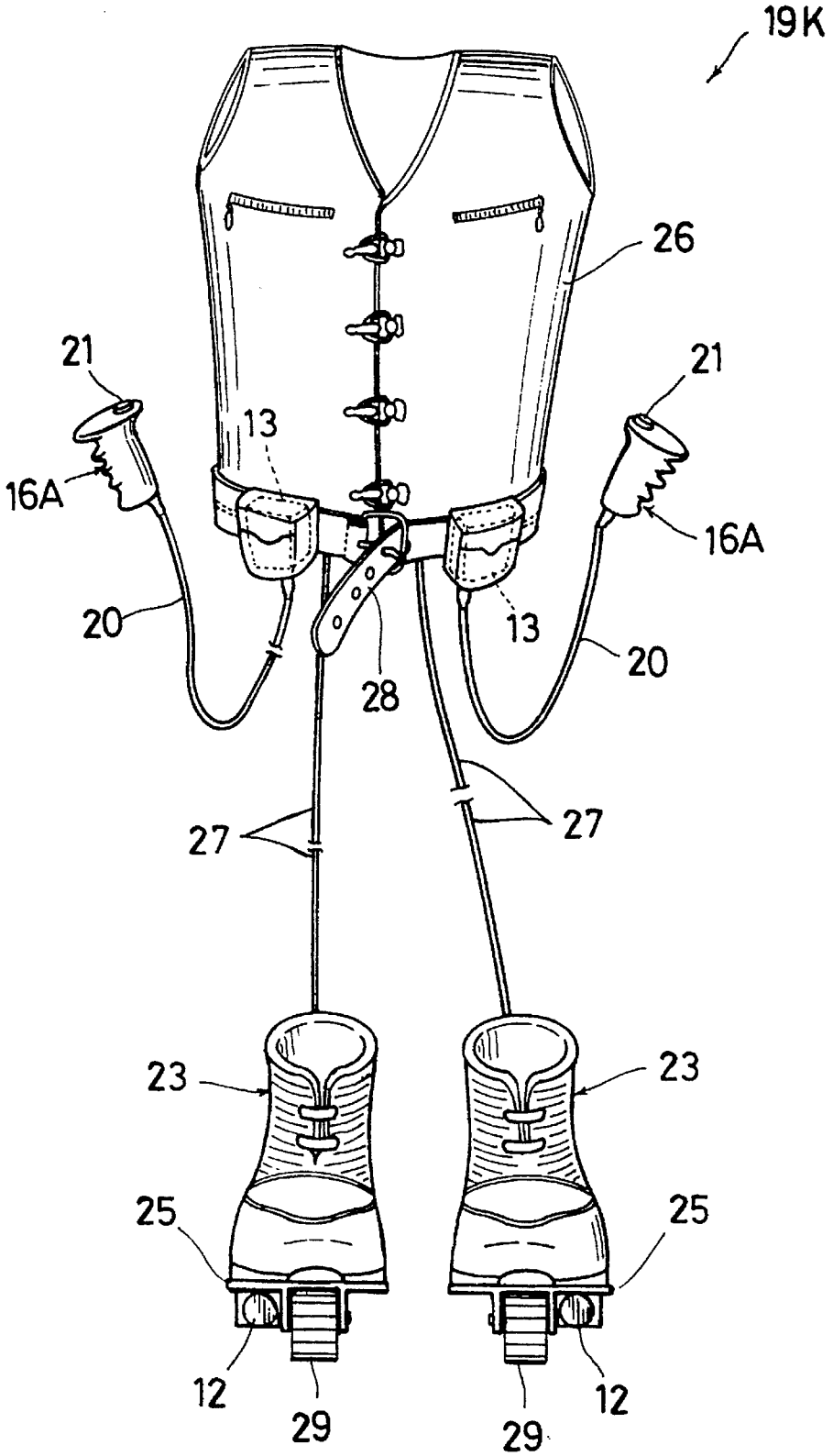

As illustrated in FIGS. 36 and 37, a twelfth embodiment of the present invention is distinguished from the eleventh embodiment by the fact that the two boards 25, 25 have at bottom two caterpillars 29, 29 respectively in place of the wheels, each caterpillar 29 being driven by the geared motor 12. Accordingly, a powered playing instrument 19K arranged as a pair of skating shoes will ensure equal effects to those of the ninth embodiment.

Although the solar cells are mounted to the vest-like garment that the player is wearing throughout the embodiments 9 to 12, they are not limited to this arrangement and may be attached to the boards or shoes with equal success.

As apparent from the above description, the following advantages will be obtained according to the present invention:

(1) A powered playing instrument according to the present invention is provided for self-propelling, comprising a board on which a foot or both feet of the player are placed, wheels mounted to front and/or rear locations of the bottom surface of the board, a driving wheel propelled by a geared motor and mounted to a front or rear location of the bottom surface of the board, a battery mounted to the board for energizing the geared motor for the driving wheel, and a switch unit for turning on and off the geared motor by remote or radio control means or by sensing a pressure exerted on to the board.

The powered playing board will thus allow the player to carry out a long-distance run without much fatigue.

(2) As apparent from the description in the paragraph (1), the powered playing board can run at a constant speed thus allowing the player to enjoy maneuvering without taking a wearisome driving action.

(3) As apparent from the description in the paragraph (1), the powered playing board is driven by electric power thus making skateboarding and rollerskating easy for everybody.

(4) As apparent from the description in the paragraph (1), the powered playing board is driven by electric power thus ensuring the transmission of power even on a slope and minimizing the occurrence of flammable accidents as compared with a conventional combustion engine using e.g. gasoline.

What is claimed is:

1. A motorized board with pressure actuated power switch comprising:

a board for supportingly receiving a player's foot;

wheels mounted to front and rear locations of a bottom surface of the board;

a driving wheel propelled by a geared motor and mounted to the bottom surface of the board;

a battery mounted to the board for energizing the geared motor for the driving wheel;

a switch unit carried on an upper surface of the board and operable responsive to a player foot pressure imposed thereon for turning on the geared motor, the switch unit being in off condition in an absence of said foot pressure imposition; and said switch unit including a pressure switch for circuit connecting the battery with the geared motor, and an isolator switch intervening circuit connection of the pressure switch with one of the battery and the geared motor.

* * * * *